US007794103B2

(12) United States Patent
Hoover

(10) Patent No.: US 7,794,103 B2
(45) Date of Patent: Sep. 14, 2010

(54) PARKING SPACE BARRIER BLOCK WITH PHOTOVOLTAIC ILLUMINATION

(76) Inventor: Scott C. Hoover, 1908 Kings Pass, Heath, TX (US) 75032

( * ) Notice: Subject to any disclaimer, the term of this patent is extended or adjusted under 35 U.S.C. 154(b) by 45 days.

(21) Appl. No.: 11/840,063

(22) Filed: Aug. 16, 2007

(65) Prior Publication Data

US 2009/0046451 A1 Feb. 19, 2009

(51) Int. Cl.
*E01F 9/00* (2006.01)

(52) U.S. Cl. ..... 362/153.1; 362/253; 362/800; 404/9; 404/10; 404/22

(58) Field of Classification Search ..... 362/153.1, 362/253, 800; 404/9–10, 12, 14, 22, 93–94
See application file for complete search history.

(56) References Cited

U.S. PATENT DOCUMENTS

| | | | | |
|---|---|---|---|---|
| 2,920,184 | A * | 1/1960 | Kessler | 362/152 |
| 3,590,959 | A | 7/1971 | Ferketich | |
| 3,636,829 | A | 1/1972 | Palmer | |
| 3,720,406 | A | 3/1973 | Artz | |
| 4,142,814 | A | 3/1979 | Sanchez | |
| 4,594,021 | A | 6/1986 | Schafer et al. | |
| 4,762,438 | A | 8/1988 | Dewing | |
| 4,875,798 | A * | 10/1989 | May | 404/12 |
| 5,028,463 | A | 7/1991 | Cahill et al. | |
| 5,316,708 | A | 5/1994 | Drews | |
| D351,422 | S | 10/1994 | Morris | |
| 5,515,807 | A | 5/1996 | Speer et al. | |
| 5,667,335 | A | 9/1997 | Khieu et al. | |
| D393,320 | S | 4/1998 | Sinclair | |
| 5,772,357 | A | 6/1998 | Evans | |
| 5,816,737 | A | 10/1998 | Siblik | |
| D410,887 | S | 6/1999 | Henry | |
| 5,984,570 | A * | 11/1999 | Parashar | 404/14 |
| 6,306,484 | B1 | 10/2001 | Bove et al. | |
| 6,444,067 | B1 | 9/2002 | Bove et al. | |
| 6,481,921 | B1 | 11/2002 | Fenimore et al. | |
| 6,602,021 | B1 * | 8/2003 | Kim | 404/16 |
| 6,692,182 | B1 * | 2/2004 | Fenimore et al. | 404/7 |
| 6,739,735 | B2 * | 5/2004 | Talamo et al. | 362/249 |

* cited by examiner

*Primary Examiner*—Sandra L O'Shea
*Assistant Examiner*—Meghan K Dunwiddie
(74) *Attorney, Agent, or Firm*—Dennis T. Griggs; Scott T. Griggs; Griggs Bergen LLP

(57) ABSTRACT

A solar-powered parking space barrier block is configured as a one-piece molded housing of a high strength, transparent plastic material in which a photovoltaic solar panel and a DC energy storage module are inclosed. A pair of white light LED lamps provide end panel marker illumination, two yellow light LED lamps provide hazard warning illumination and a rechargeable supercapacitor storage module provides operating power. A power control circuit enables use of the solar panel as a photosensor to automatically energize the LED lamps when ambient skylight falls below a predetermined safe visibility level, and removes operating power from the LED lamps when ambient skylight rises above a predetermined safe visibility level.

16 Claims, 5 Drawing Sheets

PARKING SPACE BARRIER BLOCK WITH PHOTOVOLTAIC ILLUMINATION

BACKGROUND OF THE INVENTION

1. Field of the Invention

This invention relates generally to outdoor hazard and marker lighting for automobile parking lots, and in particular to a parking space barrier block equipped with a solar-powered safety light.

2. Description of the Prior Art

All business operators have the responsibility to maintain their property in a manner that makes it reasonably safe for public use. If they do not, and an accident occurs, the property owner is liable for damages. Therefore it is important for the business owner (and employees) to take all reasonable steps to prevent the occurrence of an accident on business property, including parking lot facilities. The parking lot owner is responsible for maintaining the parking lot in a manner such that it is reasonably safe for people using it.

Conventional outdoor parking lots are equipped with parking space barrier blocks, or wheel stops, that maintain orderly alignment of vehicles in parking spaces. The primary purpose of a parking block is to provide a front tire bumper that limits the forward parking placement of an automobile within a defined parking space. Parking blocks also prevent drivers from parking too close to a building, roadway, sidewalk or lawn. Parking blocks are easy to stumble over since they extend only a few inches from ground level, and so are difficult to see at night. Inadequate lighting is the leading cause of personal injuries caused by slip and falls over conventional parking blocks.

Outdoor lighting systems, including overhead lighting, hazard warning and marker lighting, have been used primarily for illuminating parking lots and sidewalks, located adjacent shopping centers and sports facilities. It is common to have these outdoor lights powered by electricity that is produced by a public utility company located at a remote generating facility, for example by a hydroelectric power plant, fossil fuel burning power plant or a nuclear power plant. In recent times, concerns have been raised that the high demand for electricity is straining the capacity of existing electricity generating plants. Moreover, concerns regarding the availability and environmental safety of fossil and nuclear fuel are being raised. As a result of the above factors, the price of electricity has increased substantially and alternative, renewable energy sources for supplying electrical power are now being developed for outdoor lighting and other applications as well.

A fundamental limitation on the use of conventional AC power distribution for outdoor lighting equipment is that an electrical power outlet may not be available at each point of service. This makes the supply of electricity prohibitively expensive in most cases for lighting equipment that is to be installed at remote locations where public utility service lines are not already available. This limitation is especially acute where multiple items of service load equipment are distributed over a large area, such as an outdoor parking lot, where very little space is available for accommodating the installation of AC power distribution conductors.

Various exterior lighting systems have been devised for remote applications using photovoltaic solar panels in conjunction with storage batteries. These exterior lighting systems have been designed such that solar energy is converted to electrical current by an array of photovoltaic cells, which charge a storage battery during daylight hours. The storage battery can subsequently provide electrical current for a lighting unit at night or at day during periods of low intensity ambient light. These systems are designed specifically for a rechargeable storage battery that is mounted on a fixed pole or tower.

Tower-mounted solar panel/battery storage units provide an independent power source for supplying outdoor lighting fixtures that are installed at remote locations. However, tower-mounted solar installations have been limited somewhat because of the costs involved with installation and maintenance, problems with battery systems, compliance with building code restrictions and vulnerability to vandalism and storm damage. Solar panel installations for parking lot applications have also been limited by the need to avoid encroachment on parking spaces and the cost of running underground AC power distribution cables from a central tower-mounted solar panel unit.

BRIEF SUMMARY OF THE INVENTION

The present invention provides a parking space barrier block with an internal photovoltaic lighting assembly, useful as a marker light and hazard warning light for installation in vehicle parking lots. Illumination is provided by low DC voltage light-emitting diodes (LEDs), a high capacity, rechargeable storage capacitor module that stores electrical energy for supplying operating power to the LEDs, and an internally mounted photovoltaic solar panel that supplies electrical charging current to the storage capacitor module. The lighting assembly also includes switching circuitry that selectively applies operating voltage to the LED lamps when ambient skylight falls below a predetermined intensity level, for example at sunset, and removes operating voltage from the LED lamps when ambient skylight rises above a predetermined intensity level, for example at sunrise.

The solar powered light assembly is enclosed within a housing of a durable, thermoplastic polycarbonate resin, which is molded in the form and size of a conventional parking space barrier block. The electronic circuit components are encapsulated within moisture-proof potting compounds according to conventional sealing techniques for small electronic devices.

The LED lamps are optically coupled to a pair of transparent end panels that serve as marker lights and a transparent top panel that serves as a hazard warning light. The end panels are illuminated by white light glowing LED lamps that identify the boundaries of safe walking areas adjacent the parking blocks. The top panel is illuminated by a pair of yellow light glowing LED lamps that indicate the presence, general location and orientation of the parking space barrier block. The top panel also provides a weather proof, transparent shield over a top-mounted photovoltaic solar panel.

BRIEF DESCRIPTION OF THE SEVERAL VIEWS OF THE DRAWING

Comparable or corresponding parts are identified by the same reference numerals throughout the detailed description and the several views of the drawing, wherein.

DETAILED DESCRIPTION OF THE INVENTION

Figure 9:
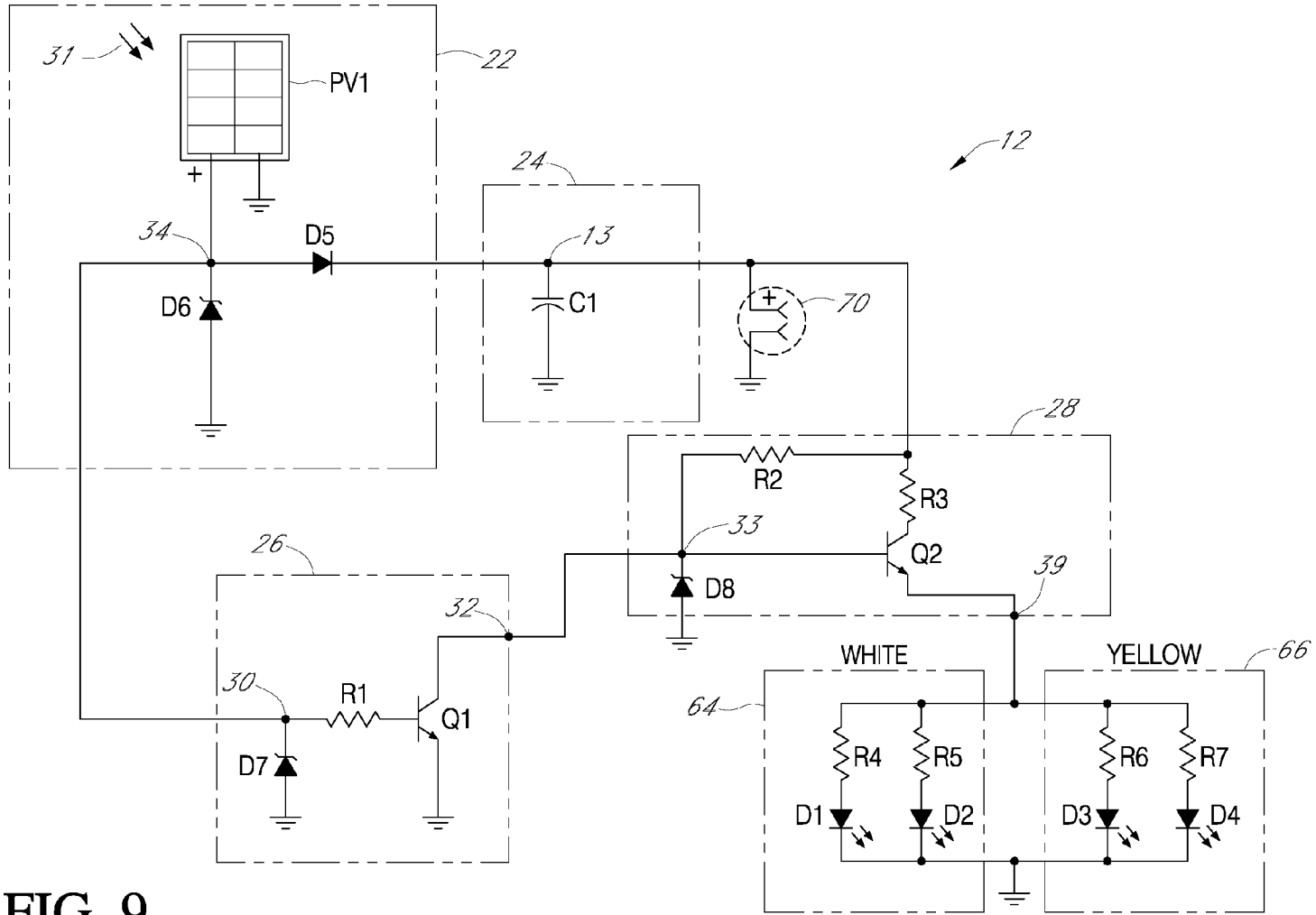
FIG. 9 is a circuit diagram of a photovoltaic power supply and LED light assembly according to the preferred embodiment of the invention.

FIGS. 1-6 show a parking space barrier block 10 equipped with a DC power supply 12 having a DC charging circuit 22 for supplying electrical operating power to illuminate end marker lighting panels 14, 16 and a top hazard warning panel 18. The DC charging circuit 22 includes a conventional photovoltaic solar panel PV1, a blocking diode D5 and a clamping diode D6 as shown in FIG. 9. Preferably, the end panels and top panel are formed together with front and rear tire engaging panels, 15, 17 and a ground engaging base panel 19 as integral portions of a protective housing 20.

The housing 20 is molded in the general form and dimensions of a conventional parking space barrier block. In the preferred embodiment, the base 19 of the parking block 10 is seven feet in length, eight inches wide and stands seven inches high, with sloping end panels 14, 16 and sloping front and rear panels 15, 17. The molded housing 20 is hollow and preferably fabricated from a durable, high-strength plastic material by any conventional method, preferably by rotational molding. In the preferred embodiment, the housing 20 is made of a transparent thermoplastic polycarbonate, for example Lexan® brand thermoplastic resin manufactured by General Electric Corporation.

Referring now to FIGS. 3, 4, 5, 6 and 7, the base panel 19 is intersected by a rectangular window opening 21 that provides access to a main internal pocket 23 in which the photovoltaic solar panel PV1, charging circuit 22, electrical charge storage unit 24, light-emitting diode lamps (LEDs) D1, D2, D3, D4 and control circuits 26, 28 are secured. The main internal pocket 23 is enlarged by a left wing pocket 23A and a right wing pocket 23B. The solar panel PV1 and charge storage module 24 are enclosed in the main internal pocket 23. The control circuits 26, 28 are enclosed within the right wing pocket 23B. All components are totally enclosed within and protected by the hollow plastic body 20.

Figure 1:
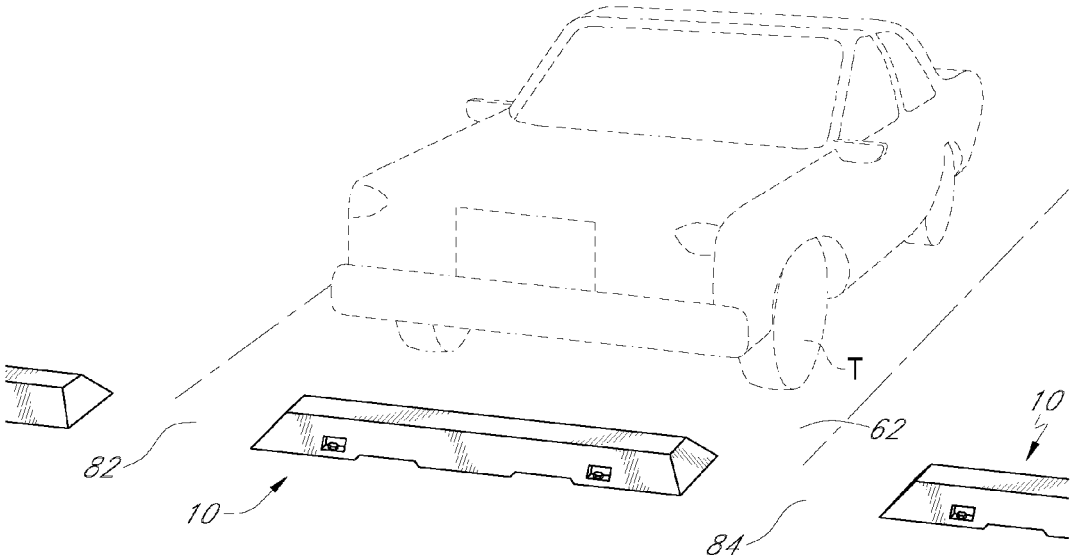
FIG. 1 is simplified perspective view of an automobile parking lot in which a parking space barrier block equipped with a photovoltaic solar panel light assembly provides hazard warning and marker lighting.

The integrally formed front and rear panels 15, 17 must be able to withstand compression forces as they restrain parking movement of a vehicle tire T (FIG. 1). Most of the compression forces exerted against the parking block are applied against the left and right end portions of the parking block. Accordingly, the parking block 19 is reinforced by a pair of full section, left and right lateral shoulder portions 25, 27 and a pair of upright, full section web portions 35, 37. The shoulder portions are integrally formed with the upright web portions and extend continuously in full section from the base panel 19 to the top panel 18.

The upright web portions 35, 37 are intersected by blind bore web pockets 41, 43 that open laterally from the main internal pocket 23 and receive the white light LED lamps D1, D2. Likewise, the shoulder portions are intersected by vertically extending, blind bore shoulder pockets 45, 47 that also open from the main internal pocket 23 and receive the yellow light LED lamps D3, D4. The housing 20 thus formed provides a high strength, rigid shell enclosure with transparent, light transmitting panel portions 14, 16, 18 that provide high strength resistance to compression forces imposed by parking engagement of an automobile tire.

The transparent end panels 14, 16 of the housing 20 receive illumination from white light-emitting diode lamps (LEDs) D1 and D2 that are contained in sealed modules 64L, 64R. The hazard warning panel 18 receives illumination from yellow light-emitting LED lamps D3, D4 that are contained in sealed modules 66L, 66R. Each light-emitting diode (LED) lamp is a semiconductor diode that emits incoherent narrow-spectrum light, a form of electroluminescence, when its p-n junction is electrically biased in the forward direction. The color of the emitted light depends on the composition and condition of the semiconducting material used.

Figure 2:
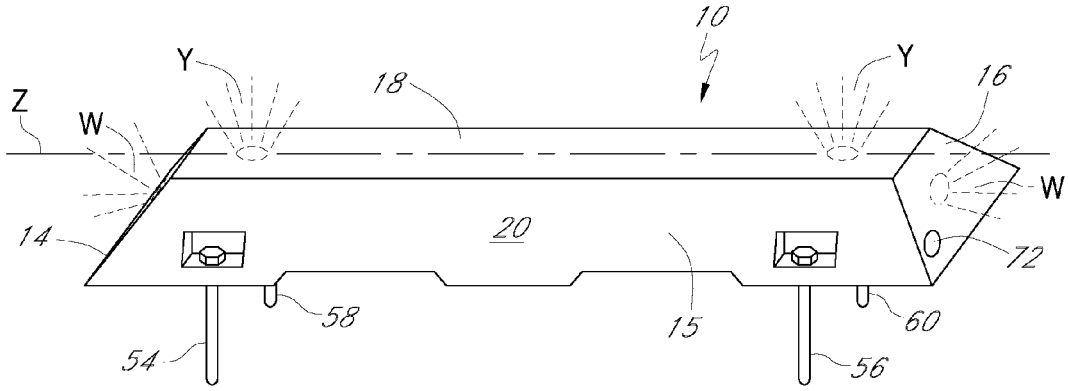
FIG. 2 is a perspective view of a parking space barrier block constructed according to the present invention.
Figure 7:
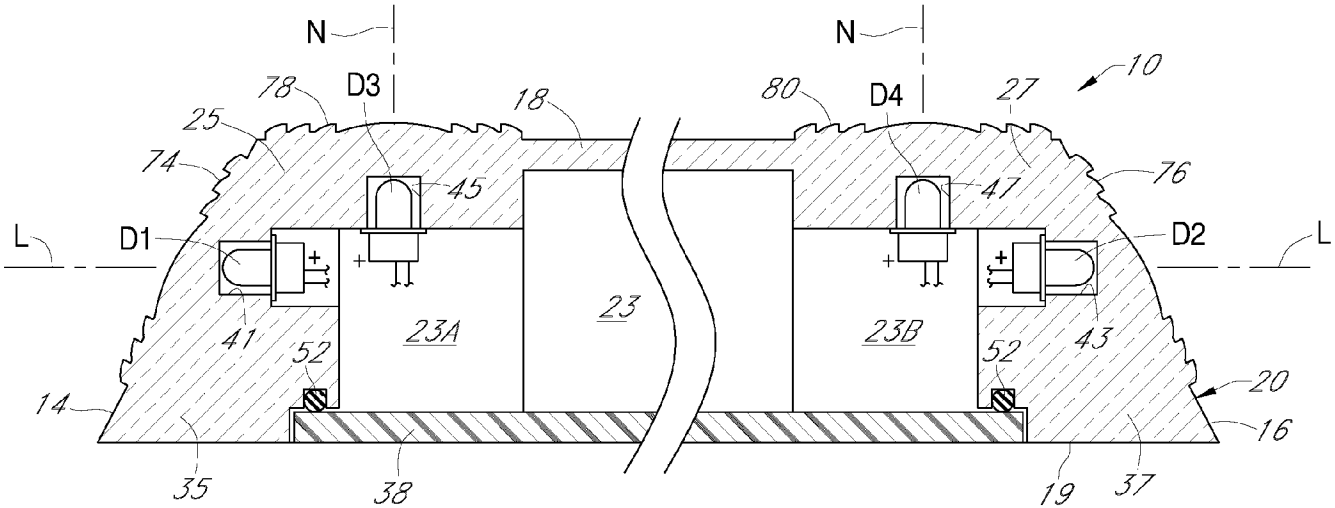
FIG. 7 is longitudinal sectional view taken along line 7-7 of FIG. 8 showing preferred placement of internal pockets and Fresnel lens diffusers.

The marker lamps D1, D2 and hazard lamps D3, D4 are received within the lamp pockets and are closely coupled to the transparent panel portions for efficient transmission of white illumination light W and yellow illumination light Y as shown in FIG. 2 and FIG. 7. Preferably, the projection beam axis L of each marker lamp D1, D2 extends laterally in parallel with the longitudinal axis Z. Moreover, it is preferred that the projection beam axis N of each hazard lamp D3, D4 extends generally at a right angle to the longitudinal axis Z and the plane of the transparent top panel 18. The angular disposition of the hazard lamp beam axis N relative to the marker lamp beam axis L, together with the location of the hazard lamps in alignment with the longitudinal axis Z, provide a distinctive pattern that is easy to recognize at night. The glowing, contrasting color lamps provide visual reference points that indicate the general location and orientation of parking blocks, and the white glowing lamps indicate the general location of a clear pathway between adjacent parking blocks.

In the preferred embodiment, the lamps D1 and D2 are high intensity white-light LED lamps, Part No. OVLEW5CB6 manufactured by Optek Technology, Inc. Each lamp is enclosed in a 5 mm flat-topped cylindrical package with a 50 degree viewing angle. Each marker lamp provides 1,600 mcd luminous intensity white light at 20 mA forward current and 3.4 VDC (forward voltage). The lamps D3 and D4 are high intensity yellow light LED lamps, Part No. OVLLY8C7 manufactured by Optek Technology, Inc. Each lamp is enclosed in a 5 mm flat-topped cylindrical package with an 85 degree viewing angle. Each hazard warning lamp provides 650 mcd luminous yellow light intensity at 20 mA forward current and 2.2 volts DC (forward voltage).

The power supply 12 includes a charge storage unit 24 in which electrical energy is stored in a high capacity DC storage capacitor C1. The storage capacitor C1 has a charging node 13 for receiving electrical current from the solar panel PV1 during daylight operation and for supplying operating current to the LED lamps during night operation. The solar panel PV1 contains an array of photovoltaic cells that convert ambient skylight to direct current. As used herein, ambient skylight includes direct and indirect solar radiation received by the solar panel. Preferably, the photovoltaic cells are monocrystalline silicon cells having cell dimensions 20 mm (0.8 inch) wide and 20 mm (0.8 inch) long, with each cell generating about 100 mA current at 0.5 volt DC under ideal skylight conditions. The solar panel PV1 includes several cells connected in series, and in a number of parallel connected rows, to provide the desired output power.

The parking block housing 20 has nominal dimensions of seven feet in length, a base width of eight inches wide, a top panel width of five inches and stands seven inches high. The main internal pocket 23 accommodates a flat photovoltaic solar panel PV1 of about 180 square inches (about 108,000 sq. mm). That surface area accommodates an array of 270 cells (20 mm×20 mm) arranged in three parallel connected groups, each group containing 90 cells arranged in a 30×3 array. Each cell group generates 300 mA at 15 volts, and the parallel connected groups collectively produce 900 mA at 15 volts, yielding about 13 watts under ideal skylight conditions.

Referring now to FIG. 9, the photovoltaic solar panel PV1 charges the DC storage capacitor C1 through a series connected blocking diode D5. The blocking diode prevents discharge of current from the storage capacitor C1 back through the solar panel at night. The blocking diode D5 is a general purpose rectifier, Part No. P600A, rated for 50 volts DC maximum blocking service and 6 amps maximum average forward current. The blocking diode P600A can be obtained from several domestic vendors, including Vishay Semiconductor Division of Vishay Intertechnology, Inc.

A shunt-connected clamping diode D6 prevents overcharging of the storage capacitor C1, and limits the potential of the applied charge to not more than 15 volts DC. The clamping diode D6 is preferably a silicon Zener diode, Part No. 1N3306B, manufactured by Motorola Corporation, with a nominal clamping voltage of 15 volts DC, rated for 50 watts (peak) service.

Preferably, the storage capacitor C1 is a "supercapacitor" or "ultracapacitor" module that includes two current collecting electrode plates suspended within an electrochemical electrolyte. Energy is stored in the form of an electrical charge that accumulates on the surfaces of the separated electrodes. For detailed information on the operation and performance of ultracapacitors, refer to U.S. Pat. Nos. 5,621,607, 5,777,428, 5,862,035, 5,907,472, 6,059,847, 6,094,788 and 6,233,135, each of which is hereby incorporated by reference in its entirety. Preferably, the storage capacitor C1 is an ultracapacitor charge storage unit 24 manufactured by Maxwell Technologies, Model No. BPAK00250P016, having a capacitor value of 250 Farads and rated for 16 volts DC power supply service.

The power supply 12 includes a photosensor control circuit 26 that enables charging of the storage capacitor C1 during daylight hours and automatically applies operating power from the storage capacitor to the LED lamps D1, D2, D3, D4 when ambient skylight drops below a predetermined level. A transistor switch Q1 controls the application of driving current from the capacitor storage unit 24 to the LEDs through a LED power driver transistor Q2. Voltage generated by the solar panel PV1 is conducted via voltage output terminal 34 to the base of transistor switch Q1 through an input node 30. The resistor R1 and a clamping diode D7 form a bias circuit across the base input node 30 of transistor Q1.

The transistor switch Q1 is a general purpose, type NPN silicon transistor, Part No. 2N930, manufactured by Motorola Corporation, rated at 300 mW service. The LED power driver transistor Q2 is a medium power, type NPN silicon transistor, Part No. 2N3055, manufactured by Motorola Corporation, rated at 115 watts service.

The voltage developed by the Zener clamping diode D7 at input node 30 is reduced by resistor R1 and applied as a bias voltage across the base-emitter junction of the transistor switch Q1. The resistance value of R1 and the Zener voltage of the clamping diode D7 are selected to establish a base-emitter voltage sufficient to render Q1 conducting (ON) when the voltage output from the photovoltaic array PV1 rises above a predetermined threshold value. The Zener diode D7 clamps the voltage on the input node 30 at 3.3 VDC. The value of R1 is selected to drop the voltage applied across the base-emitter junction of Q1 to about 0.8 VDC. This bias voltage is sufficient to render Q1 conducting and is well below its maximum breakdown voltage $V_{BE}$. When Q1 turns ON, its collector-emitter current is limited to a safe value by resistor R2.

The component values of R1 and D7 are coordinated to produce Q1 turn-ON when the intensity of incident skylight, indicated by arrows 31 in FIG. 9, rises above a predetermined intensity level. Using the typical component values given in Table 1, and assuming a skylight intensity of 400 lux at sunrise, Q1 will turn ON and Q2 will turn OFF (LEDs OFF). Likewise, Q1 will turn OFF and Q2 will turn ON (LEDs ON) at sunset on a clear day (for example at location latitude +32.85 N, longitude −96.48 W).

The collector output terminal 32 of transistor switch Q1 is connected to the gate input node 33 of the LED power driver transistor Q2. The gate input node 33, formed between resistor R2 and clamping diode D8, applies the clamping voltage of Zener diode D8 as a bias voltage to the base of the driver power transistor Q2 when Q1 is OFF. The clamping diode D8 is a Zener diode whose clamping voltage is selected with due consideration of the operating voltage drop across the LED lamps and their current limiting resistors, which typically is a total of about 8 VDC for the LED components identified in Table 1. The power driver transistor Q2 requires a base-emitter bias of about +1 VDC to turn ON in saturation switching mode. Accordingly, the clamping diode D8, which is rated at a clamping voltage of 9.1 VDC, produces a differential turn-on bias (about 1.1 VDC) across the base-emitter junction of Q2 when Q1 is OFF.

When Q1 turns ON, Q2 is rendered non-conducting (OFF), since its base-emitter bias voltage is pulled to near zero reference potential when Q1 conducts in saturation switching mode. When a turn-ON bias voltage develops across the LED driver input node 33, Q2 turns ON and conducts operating current through the power output node 39 to the LED lamp groups 64 (white) and 66 (yellow). The operating currents flowing through the LED lamps D1, D2, D3 and D4 are limited to safe operating values by series connected resistors R4, R5, R6 and R7. Resistor R3 protects Q2 by limiting collector current under short circuit conditions.

Operating power is disconnected from the LED lamps when Q2 turns OFF. This enables the current output of the solar panel PV1 and output of control circuit 26 to be used as a photosensor input to the power driver circuit 28. The power driver circuit 28, responding to a low ambient light intensity photosensor input from control circuit 26, automatically applies operating power to the LED lamps through its switched output emitter terminal and power output node 39 when ambient light intensity falls below a predetermined safe visibility level, for example unclouded skylight intensity at sunset on a clear day.

The LED power driver circuit 28, responding to a high ambient light intensity signal input from photosensor control circuit 26, automatically removes operating power from the LED lamps when ambient light rises above a predetermined intensity level, for example unclouded skylight intensity level at sunrise on a clear day. When operating power is removed from the LED lamps (Q1—ON and Q2—OFF), nearly all of the solar cell current output of the solar panel PV1 becomes immediately available for charging the storage capacitor C1. A small fraction of the power output, typically less than 50 milliwatts, is consumed by Q1 and its bias circuit during daylight operation (Q2 OFF).

The power switching transistor Q2 controls the application of operating voltage to the white-light marker LED lamps D1, D2 and yellow-light hazard warning panel LED lamps D3, D4. The collector output terminal 32 of the switching transistor Q1 is connected to the signal input node 33 of the driver power control circuit 28. In the absence of sufficient ambient lighting, the output of the solar panel 22 does not provide enough driving current to develop a bias voltage that exceeds the turn-on threshold of transistor Q1. Consequently, under defined low-level ambient skylight intensity conditions (for example, less than 400 lux), Q1 is non-conducting (OFF), and a bias voltage develops across the power driver input node 33 as current flows through the Zener diode D8.

The bias voltage is clamped at a turn-on voltage level by Zener diode D8, rendering Q2 conducting (ON), and applying operating power to the LED lamp group 64 (white light illumination) and LED lamp group 66 (yellow light illumination). When ambient skylight intensity rises above the defined threshold value, Q1 turns ON, pulling the input node 33 and base of Q2 to near zero reference potential. Resistor R2, which provides bias current to Q2, has a resistance value of 10 K ohms and is connected in series with the collector of Q1 through the input node 33, thereby safely limiting the current flowing through the collector and grounded emitter of Q1 to less than 1.5 mA under maximum photovoltaic supply conditions. Consequently, Q2 is rendered non-conducting (OFF), thus removing operating power from both LED groups during daylight operation.

The electronic control circuits 26 and 28 ensure that after sunset and at night, the LED lamps turn ON and are powered by the electrical energy stored in the charge storage unit 24. After sunrise and during the day, operating power to the LEDs is removed while the storage capacitor C1 is recharging.

During daylight operation, the average amount of power dissipated by the photosensor control transistor Q1 and its bias circuit is less than 50 milliwatts. During night operation, the average amount of power dissipated by the LED lamps D1, D2, D3, D4, transistor Q2, biasing resistor R2, clamping diode D8 and current limiting resistors R3, R4, R5, R6 and R7 is less than one watt. Therefore the accumulated energy stored in C1, when fully charged, is sufficient to supply operating power to the control circuits 26, 28 and LED lamps for two or three days of overcast or below average skylight conditions, where peak skylight intensity does not exceed 400 lux.

The solar panel PV1 will replenish the charge on the storage capacitor C1 in three or four hours during each day of average or above average skylight conditions, for example, average local skylight intensity not less than 400 lux. The large energy storage capacity of the power supply 12 accommodates variable weather conditions including extended overcast, stormy and cloudy days when regular charge recovery may be delayed.

Figure 8:
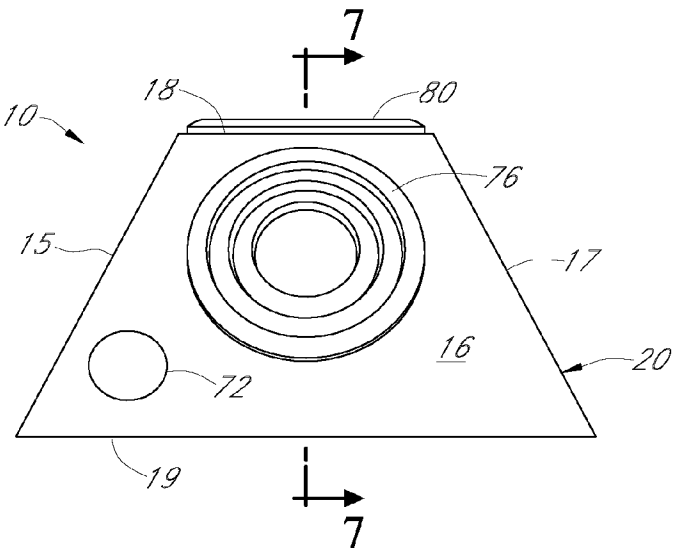
FIG. 8 is right side elevation view thereof showing preferred placement of a Fresnel lens diffuser and a DC charging service receptacle.

If for some reason the charge on the storage capacitor C1 becomes exhausted, a full energy charge can be restored by a portable battery charger. For this purpose, a DC charging service receptacle 70 is connected across the positive and negative charging terminals of the charge storage unit 24. The service receptacle 70 is mounted on the exterior surface of the end panel portion 16 for convenient access (FIG. 2, FIG. 8). The service receptacle 70 is sealed by a weather cap 72 which is rated for outdoor service.

There is no requirement for a mechanical switch or voltage converter for proper operation of the DC power supply 12. The power control circuitry is supplied by the photovoltaic solar panel PV1 which has a sufficiently high voltage output (15 VDC nominal) so that the energy storage capacitor C1 can be fully charged without step-up voltage conversion. This avoids the requirement for extra operating power and stabilizing circuits. Similarly, no voltage conversion or stabilization is required to drive the LED lamps. The electrical energy stored in the charge storage unit 24 is supplied directly without conversion, which is made possible because the LED lamps operate and provide effective illumination over a wide range of operating voltage.

Referring again to FIG. 6, the ground-engagable underside panel 19 of the housing 20 is fitted with a service door 38 that is coupled to the housing by hinges 40, 42, 44. The service door is secured by machine bolt fasteners 46, 48 and 50 which must be removed to provide access to the components of the lighting assembly for repair and replacement. The service door 38 is sealed against the housing by a weather-rated compression gasket 52. The gasket 52 provides a watertight union when compressed, which prevents ground water penetration and keeps the internal power supply components dry.

Referring again to FIG. 1 and FIG. 2, the parking surface 62 of conventional parking lots is usually concrete or asphalt. The parking barrier block 10 includes anchor bolts 54, 56, 58 and 60 for attaching the housing 20 to the hard parking lot surface 62, thereby securing the block against lateral and longitudinal movement. Each anchor bolt includes a spike or shank portion that extends through the housing base 19 and into the parking lot surface 62.

The solar powered light assembly 12 may be configured to satisfy various outdoor lighting applications and may be incorporated in housings of appropriate size and lamp configuration. For example, a single LED lamp can be located at one end of a housing to provide unidirectional marking for sidewalk installations, or may include multiple lamps that provide bidirectional or omni-directional marker illumination for airport and marine applications.

The beam spread of the some LED lamps may be relatively narrow. Therefore, in order to improve visibility when narrow beam lamps are installed, a light diffuser is included as part of the transparent panel portions of the housing 20. For example, as shown in FIG. 7 and FIG. 8, Fresnel lens diffusers 74, 76 are integrally formed with the transparent end panels 14, 16 and Fresnel lens diffusers 78, 80 are integrally formed with the transparent top panel 18. Preferably, each lamp is positioned closely adjacent to the transparent panel with its projection axis N, L in coaxial alignment with the center of the diffuser.

Figure 3:
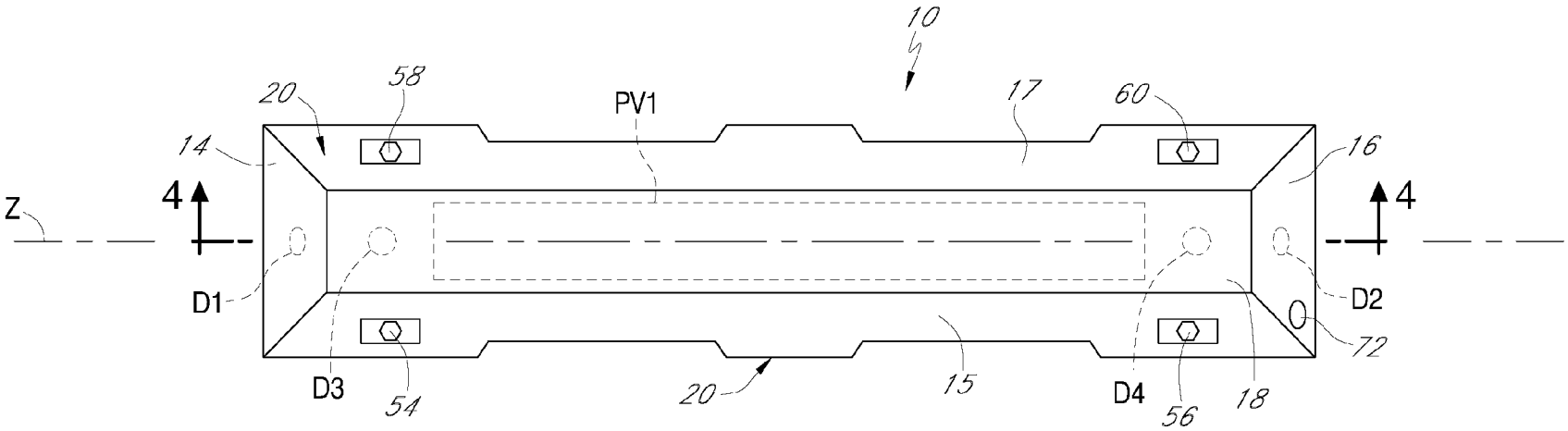
FIG. 3 is a top plan view thereof.
Figure 4:
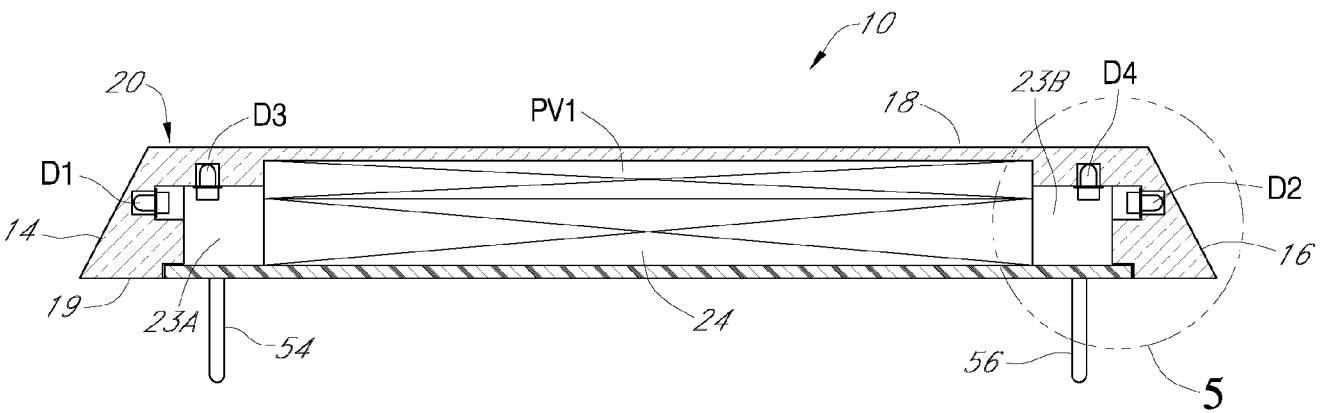
FIG. 4 is sectional view thereof taken along the line 4-4 of FIG. 3.
Figure 5:
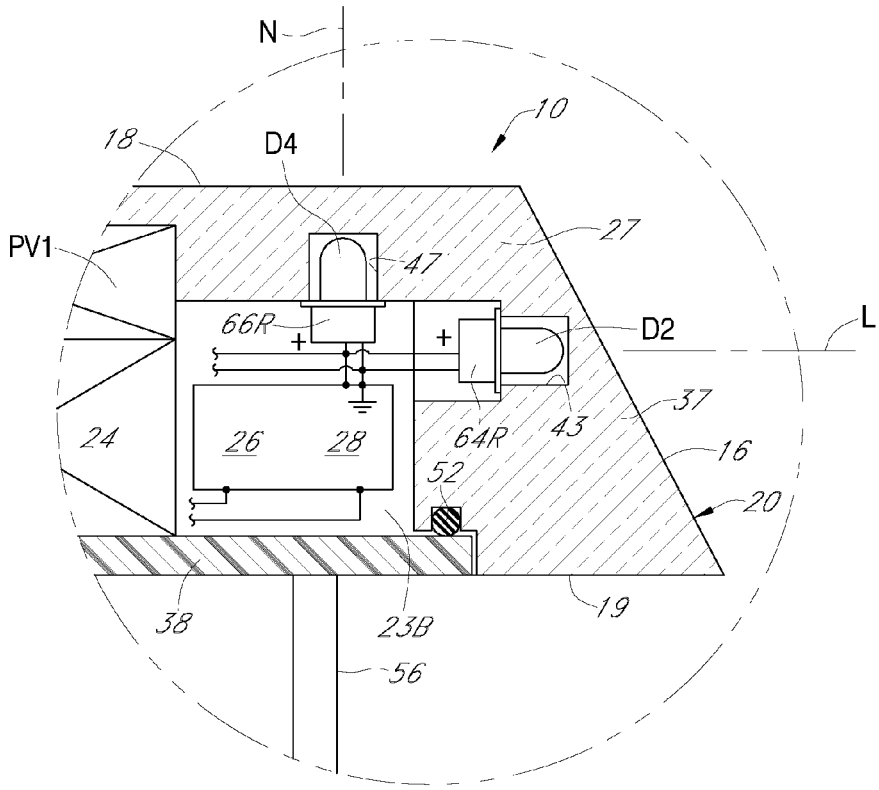
FIG. 5 is an enlarged sectional view of the right end portion thereof.
Figure 6:
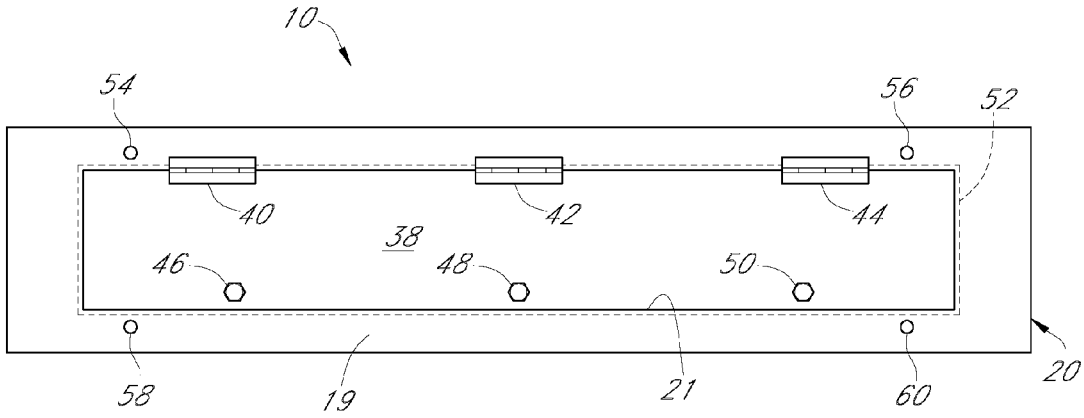
FIG. 6 is bottom plan view thereof.

The yellow glowing light beams Y projected from the spaced hazard warning lamps D3, D4 is easy to see at night. Preferably, the yellow light hazard warning lamps D3, D4 are mounted in alignment with the longitudinal centerline axis Z of the housing 20 as shown in FIG. 2 and FIG. 3. The straight line pattern identifies the general location and orientation of a parking block 10 and provides a specific indication of where not to step, even though the parking block itself may not be clearly visible. The white glowing lights W projected from the marker lamps D1, D2, on the other hand, provide a specific indication of where the parking block ends. The visual pattern produced by a pair of white glowing lamps widely spaced apart and mounted on facing end portions of adjacent parking blocks, provide a specific indication of where it is safe to step. The widely spaced white lights W mark the left and right end portions of adjacent parking blocks, and illuminate the unobstructed pathways 82, 84 between adjacent parking blocks, as shown in FIG. 1.

The photovoltaic lighting assembly of the present invention is adaptable to a variety of lighting applications, in addition to automobile parking lots. In the preferred embodiment, the solar lighting system is incorporated within a parking space barrier block to provide parking space marker and hazard warning illumination at troublesome parking lot locations where it is difficult, expensive or impossible to run conventional AC power conductors. The invention avoids electric meters and monthly bills, power company charges for bringing electric service to the site, land use zoning issues, limitations on carrying AC power across properties, building code restrictions, environmental impact considerations, building permits, and the inevitable delays caused by all these factors. Installation is simple and the system is virtually maintenance free.

The present invention relies on the energy efficiency of supercapacitor energy storage technology and low voltage light-emitting diodes (LEDs), and therefore does not need a battery or voltage converter. The resulting solar-powered lighting assembly provides a combination hazard warning light and parking space barrier block of simple design, makes efficient use of available natural skylight for its operating power, and can withstand normal contact with vehicle tires in parking lot service. Because of its rugged construction, it is resistant to vandalism and storm damage, and requires minimal servicing.

The invention has been particularly shown and described with reference to a preferred embodiment in which examples have been given to explain what I believe is the best way to make and use the invention. The components and values given in the detailed description and Table 1 are exemplary of those that may be used in the successful practice of the invention. It will be understood by those skilled in the art that various changes in form and detail may be made therein without departing from the spirit and scope of the invention.

TABLE 1

| Reference | Component | Function | Mfg. Part No./Value |
|---|---|---|---|
| C1 | capacitor | storage | Maxwell BMOD0250P016<br>250 Farads 16 WVDC |
| D1 | LED | marker | Optek OVLEW5CB6 white<br>3.4 VDC 20 mA |
| D2 | LED | marker | Optek OVLEW5CB6 white<br>3.4 VDC 20 mA |
| D3 | LED | hazard | Optek OVLLY8C7 yellow<br>2.2 VDC 20 mA |
| D4 | LED | hazard | Optek OVLLY8C7 yellow<br>2.2 VDC 20 mA |
| D5 | diode | blocking | Vishay P600A<br>50 VDC 6 amps |
| D6 | diode | clamping | Motorola 1N3306B<br>Zener 15 VDC 50 watts |
| D7 | diode | clamping | Motorola 1N746A<br>Zener 3.3 VDC 500 mW |
| D8 | diode | clamping | Motorola 1N5345B<br>Zener 8.7 VDC 200 mA |
| R1 | resistor | bias | 5 K ohms ½ watt |
| R2 | resistor | bias | 10 K ohms 1 watt |
| R3 | resistor | current limit | 560 ohms ½ watt |
| R4 | resistor | current limit | 220 ohms ½ watt |
| R5 | resistor | current limit | 220 ohms ½ watt |
| R6 | resistor | current limit | 330 ohms ½ watt |
| R7 | resistor | current limit | 330 ohms ½ watt |
| Q1 | transistor | switch | Motorola NPN 2N930 |
| Q2 | transistor | power driver | Motorola NPN 2N3055 |

I claim:

1. A parking space barrier block comprising, in combination:

a housing including a transparent top panel and first and second transparent end panels forming boundaries about a main internal pocket, the housing including first and second side panels extending between the first and second transparent end panels thereby defining front and rear tire-engagable side panels of the barrier block, respectively, the front and rear tire-engagable side panels being adapted in length to restrain the parking movement of a vehicle tire;

a photovoltaic solar panel enclosed in the main internal pocket subjacent the transparent top panel for receiving skylight illumination, the solar panel having a voltage output terminal for supplying operating voltage in response to illumination of the solar panel by skylight;

an electrical charge storage unit enclosed in the main internal pocket, the charge storage unit having a charging node electrically coupled to the voltage output terminal of the solar panel;

a lighting assembly enclosed in the main internal pocket, the lighting assembly including first and second marker lamps positioned in illuminating proximity adjacent the first and second transparent end panels, respectively, and first and second hazard warning lamps positioned in illuminating proximity adjacent the transparent top panel; and a power control circuit enclosed in the internal pocket and coupled between the charging node of the charge storage unit and the lighting assembly for controlling the application of operating voltage to the lighting assembly.

2. A parking space barrier block according to claim 1, the power control circuit including a power input terminal coupled to the charging node of the charge storage unit, a power output terminal coupled to the lighting assembly and a gate terminal coupled to the voltage output terminal of the solar panel for opening and closing a current conductive circuit between the power input terminal and power output terminal in response to the rise and fall of voltage on the output terminal of the solar panel relative to a predetermined threshold voltage value.

3. A parking space barrier block according to claim 1, wherein the electrical charge storage unit comprises a DC capacitor.

4. A parking space barrier block according to claim 1, in which the housing comprises an elongated body having a longitudinal axis, and the first and second hazard warning lamps are disposed at spaced apart locations generally in alignment with the longitudinal axis.

5. A parking space barrier block according to claim 1, wherein the housing comprises an elongated molded body and the top panel and end panels are integrally formed together.

6. A parking space barrier block according to claim 1, wherein the housing comprises an elongated molded body having first and second web portions extending between the base panel and the top panel, and the first and second web portions are intersected by first and second web pockets that open into the main internal pocket, and the first and second marker lamps are disposed in the first and second web pockets, respectively.

7. A parking space barrier block according to claim 1, wherein the housing comprises an elongated molded body having first and second shoulder portions integrally formed with the transparent top panel and extending on opposite ends thereof, and the first and second shoulder portions are intersected by first and second shoulder pockets that open into the main internal pocket, and the first and second hazard warning lamps are disposed in the first and second shoulder pockets, respectively.

8. A parking space barrier block according to claim 1, wherein the housing comprises an elongated molded body having first and second shoulder portions and first and second web portions disposed on opposite ends of the housing, wherein the shoulder portions and web portions extend continuously in full section from the base panel to the top panel.

9. A parking space barrier block according to claim 1, the housing including a ground engagable base panel, and the first and second transparent end panels extending from the base panel to the top panel, respectively.

10. A parking space barrier block according to claim 1, the housing including first and second shoulder portions and first and second web portions integrally formed with the shoulder portions on opposite ends of the housing, respectively.

11. A parking space barrier block according to claim 1, wherein the housing comprises a molded body of thermoplastic polycarbonate resin.

12. A parking space barrier block according to claim 1, wherein the lighting assembly comprises first and second marker lamps that project light beam illumination of a first color when energized and first and second hazard warning lamps that project a light beam illumination of a second color when energized.

13. A parking space barrier block according to claim 1, in which the housing comprises an elongated body having a longitudinal axis, and the first and second marker lamps each have a projection beam axis extending generally in parallel with the longitudinal axis.

14. A parking space barrier block according to claim 1, in which the housing comprises an elongated body having a longitudinal axis, and wherein the first and second hazard warning lamps each have a projection beam axis extending generally at a right angle to the longitudinal axis.

15. A parking space barrier block according to claim 1, further comprising:

first and second transparent diffusers disposed on the first and second end panels, respectively, and at least one transparent diffuser disposed on the top panel.

16. A parking space barrier block comprising:

a housing including sidewalls enclosing an internal pocket, said housing comprising a transparent top panel disposed between transparent left and right end panels, the housing including first and second side panels extending between the transparent left and right end panels thereby defining front and rear tire-engagable side panels of the barrier block, respectively, the front and rear tire-engagable side panels being adapted in length to restrain the parking movement of a vehicle tire;

a photovoltaic solar panel disposed subjacent the transparent top panel for receiving skylight illumination, the solar panel having a voltage output terminal for supplying operating voltage in response to skylight illumination of the solar panel;

an electrical charge storage unit enclosed in the main internal pocket, the charge storage unit having a charging node electrically coupled to the voltage output terminal of the solar panel;

a power control circuit enclosed in the internal pocket and coupled between the charging node of the charge storage unit and the lighting assembly for controlling the application of operating voltage to the lighting assembly; and a lighting assembly disposed in the internal pocket, the lighting assembly including first and second marker lamps positioned in illuminating proximity adjacent the first and second transparent end panels, respectively, and first and second hazard warning lamps positioned in illuminating proximity subjacent the transparent top panel, respectively.

* * * * *